United States Patent [19]

Chen

[11] Patent Number: 4,564,966

[45] Date of Patent: Jan. 21, 1986

[54] CONSTRUCTION FOR AN ATHLETIC SHOE AND PROCESS OF MAKING

[75] Inventor: York Chen, Taipei, Taiwan

[73] Assignee: Contax Sports, Inc., Burlingame, Calif.

[21] Appl. No.: 567,075

[22] Filed: Dec. 30, 1983

[51] Int. Cl.[4] ..... A43B 13/22; A43B 13/04

[52] U.S. Cl. ..... 12/146 B; 12/146 BR; 264/244; 36/31; 36/32 R

[58] Field of Search ..... 36/31, 32 R, 25 R; 12/146 B, 146 BP, 146 BR; 264/241, 244

[56] References Cited

U.S. PATENT DOCUMENTS

| | | | |
|---|---|---|---|
| 3,246,068 | 4/1966 | Ferreira | 264/244 |
| 3,305,895 | 2/1967 | Ludwig | 264/244 |
| 3,522,340 | 7/1970 | Corcoran et al. | 264/244 |
| 3,952,429 | 4/1976 | Thomas | 36/31 |
| 4,231,169 | 11/1980 | Toyama et al. | 36/43 |
| 4,309,376 | 1/1982 | Veno et al. | 36/32 R |
| 4,455,765 | 6/1984 | Sjosward | 36/32 R |

FOREIGN PATENT DOCUMENTS

| | | | |
|---|---|---|---|
| 379125 | 1/1938 | Canada . | |
| 395892 | 4/1940 | Canada . | |
| 792977 | 8/1968 | Canada . | |
| 870873 | 5/1971 | Canada . | |
| 1027356 | 3/1978 | Canada . | |
| 1593943 | 7/1970 | France | 36/31 |

OTHER PUBLICATIONS 8303528 10/1983 PCT Dean.

*Primary Examiner*—Werner H. Schroeder
*Assistant Examiner*—Steven N. Meyers
*Attorney, Agent, or Firm*—Ciotti & Murashige

[57] ABSTRACT

A process and configuration for constructing the lower part of a spikeless type athletic shoe having molded studs on its undersurface to improve its wear-resistance is disclosed wherein portions of the sole and heel are premolded of an extra-durable material, such as high carbon content rubber, and then disposed partly cured in the shoe master mold at selected locations for molding and curing with the remainder of the sole and heel to produce a lower construction of conventional rubber molded with underface portions of extra-durability at the selected areas of greatest wear.

15 Claims, 2 Drawing Figures

CONSTRUCTION FOR AN ATHLETIC SHOE AND PROCESS OF MAKING

BACKGROUND OF THE INVENTION

The present invention relates to an improved construction and method of making the lowers of molded footwear and more particularly to an integrally molded sole and heel construction having portions of extra durability disposed on the undersurface at the areas of greatest stress and wear.

Various processes and constructions are known involving the injection of plastics and/or the molding and curing of rubber to produce molded footwear. In most of these processes, the uppers and lowers of the shoes are generally constructed to simulate parts previously made of leather. Of late, athletic shoes of the type with cleats or spikes attached to the undersurface, such as baseball, football, or golf shoes, have had the spike elements simulated by studs molded integrally with the sole and heel portions. Such shoes, as all shoes, are subjected to localized stresses, abrasion and wear during use which cause certain areas to wear out much more rapidly than others, shortening the useable life of individual shoes, and of pairs of such shoes, that are otherwise in good condition. In the past, different means have been added to the undersurfaces of shoes, typically metal tabs or rubber plugs, to act to reinforce the areas of extreme wear. However, such added means have not been found to be suitable or economical for use with molded shoes and particularly those of the spikeless type as the studs on the soles and heels are exposed to extreme stresses.

SUMMARY OF THE INVENTION

The lower part of a molded shoe is constructed in accordance with the present invention by first forming one or more portions of the sole and/or heel of a material with extra durability such as high carbon content rubber. These portions, partly cured, are disposed in the master mold for the shoe at locations on the sole and/or heel that are normally subjected to the greatest amount of stress, abrasion and wear. The entire lower part of the shoe is then molded and cured with the wear-resistant portions becoming integral with the remaining portions which may be of less expensive rubber or plastic. This process results in a construction that provides longer shoe life while minimizing the extra cost of materials in its manufacture. The construction is particularly suitable in shoes having studded undersurfaces as the studs are quite vulnerable to shearing stresses and abrasion so that the extra durability is important.

DETAILED DESCRIPTION OF THE INVENTION

Figure 1:
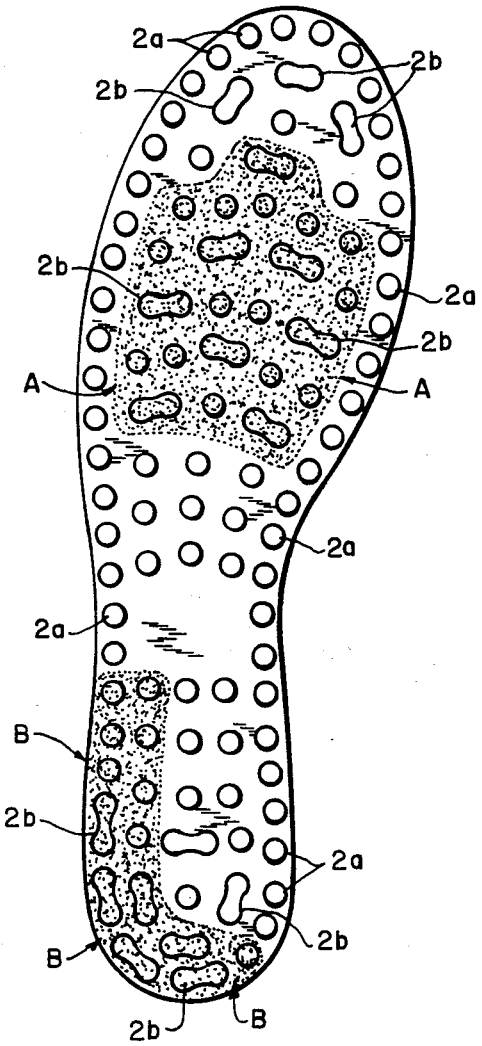
FIG. 1 is an illustrative view of the sole and heel of a golf shoe showing a construction of the present invention.

The studded sole and heel of an athletic shoe, specifically a golf shoe formed in the manner of the present invention, is shown in FIG. 1. This lower part 1 of the shoe is of molded construction with circular studs 2*a* and connected studs 2*b* all formed integrally with the body of the sole and heel. The overall construction may be of rubber, typically a mixture of natural and synthetic rubber, or of a plastic, such as polyurethane, which is shaped in a heated mold to the form of the shoe. The upper and lower of the shoe may be separately constructed and subsequently adhesively attached to each other or they may be integrally formed in a master mold. The form of construction of the shoe upper may be any that is found to be compatible with that of the lower construction in accordance with the present invention.

It is well known that certain areas of the undersurface of a shoe lower are subjected during use to greater and more frequent stress, abrasion and wear than other areas. It has been found, for example, in the case of spikeless or studded golf shoes that the center area of the sole and the outer edge and rear of the heel tend to experience greater stress and abrasion than the other areas of the undersurface, so that the studs in these areas may break off or wear down most rapidly. It is therefore desirable that the material of the undersurface in the effected areas be made more wear-resistant to extend the usable life of the shoe.

Figure 2:
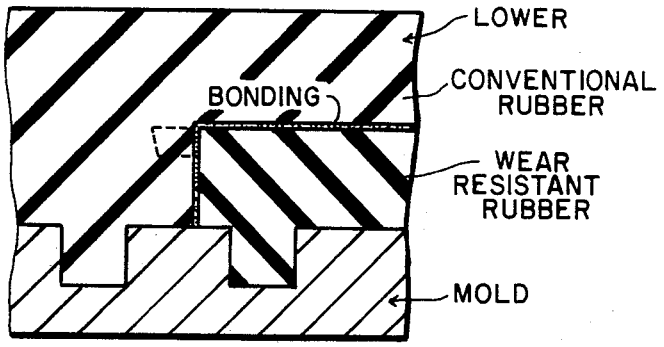
FIG. 2 is a side sectional view of a part of the sole shown in FIG. 1.

This added resistance to wear is accomplished with the present invention by construction the relevant parts of the shoe lower of a material or materials with greater durability and resistance to abrasion and wear than the conventional materials while continuing to use the latter materials for the remainder of the construction. Accordingly, portions of the lower are premolded, in the forms shown at A and B in FIG. 1, of improved strength material such as high carbon content rubber or an equivalent plastic or the like. For the purposes of the present invention a rubber having a carbon ratio of a much greater percentage than that of the conventional rubber used in molded shoes has been found to be quite suitable providing as much as a 50% increase in durability. A carbon fiber reinforced rubber may be used in applications requiring extreme durability. The wear-resistant rubber is partly cured, preferably about 70% cured, during the premolding and when properly formed is ready for incorporation into the remainder of the lower in the master mold. The premolding may be carried out in the master mold or it may be accomplished in a smaller mold and the premolded, partly cured portions then transferred to the master mold, as will be found suitable. In either event, the premolded portions are disposed in the master mold at the areas of the lower expected to experience the greatest wear, such as the areas of the sole and heel A and B shown in FIG. 1. The remainder of the material making up the lower, which material may be a conventional rubber or compatible plastic or even a less expensive material of lesser durability, is then placed in the mold and the entire lower is formed and cured by the application of appropriate heat. Typically the thickness of the preformed portions will have a thickness of about 1.5 mm while the thickness of the entire lower will be about 3.5 mm so that the preformed portions will be incorporated as insets into the lower and integrated into the body thereof upon completion of the curing as shown in FIG. 2. The resulting lower is an integrally formed sole and heel of a conventional material with areas of its undersurface including portions of increased durability at the points of greatest stress and wear. Consequently, shoes incorporating this improved lower will have an increased wear life with a minimum, if any, increase in the cost of manufacture as the use of less expensive material can offset the increased cost of the more durable material.

To insure secure incorporation of the wear-resistant portions into the remainder of the sole and heel material, these portions may be specially formed during premolding with tabs, flanges or other interlocking means which will become embedded in the surrounding material during subsequent molding and curing. For example, the upper peripheral edges of these portions may be extended such that their upper surfaces are greater in area than their lower surfaces as indicated in dotted lines in FIG. 1.

It will therefore be seen from the foregoing description that an improved construction for the lowers of molded shoes is disclosed which will permit longer shoe life by strengthening the undersurfaces and studs thereon to resist stresses, abrasion and wear. The materials of construction that will be found suitable for use with the present invention are within the purview of those skilled in the art. Also it will be understood that the invention may be applied with non-studded molded athletic shoes such as for tennis, basketball, and jogging, and with many other forms of footwear.

What is claimed is:

1. A process for producing a lower for footwear, such as a sole for an athletic shoe, comprising the steps of:

premolding and partly curing a portion of the lower of a relatively wear-resistant material;

disposing said premolded partly cured portion in a master mold including a form of the lower at a location with respect to the remaining portions of the lower that is normally subjected to a greater degree of wear;

partly surrounding said premolded portion with a material of less wear resistance in a master mold to form the remaining portion of the lower; and completing curing so as to mold all of the portions into a composite lower of integral construction with an area of its undersurface of at least one relatively wear-resistant portion at a location normally subjected to a greater degree of wear and use.

2. A process as in claim 1, wherein said remaining portion and wear-resistant portion are rubber.

3. A process as in claim 3, wherein said wear-resistant portion has a higher carbon content than the remaining portion.

4. A process as in claim 1 wherein the lower comprises a sole and said premolded portion is located substantially in the middle of the sole.

5. A process as in claim 1 wherein the lower comprises a heel and said premolded portion is located along one edge of said heel.

6. A process as in claim 1 wherein the lower comprises a heel and said premolded portion is located along the rear of said heel.

7. A process as in claim 1 wherein said premolded portin comprises a plurality of studs.

8. A process as in claim 1 wherein the lower is formed on its undersurface with a plurality of studs.

9. A lower for footwear produced by the process of claim 1.

10. The lower for footwear of claim 9 wherein said remaining portion and wear-resistant portion are rubber.

11. The lower for footwear of claim 9 wherein said wear-resistant portion has a higher carbon content than the remaining portion.

12. The lower for footwear of claim 9 wherein the lower comprises a sole and said premolded portion is located substantially in the middle of the sole.

13. The lower for footwear of claim 9 wherein the lower comprises a heel, and said premolded portion is located along one edge of said heel.

14. The lower for footwear of claim 9 wherein the lower comprises a heel and said premolded portion is located along the rear of said heel.

15. The lower for footwear of claim 9 wherein said premolded portion comprises a plurality of studs.

* * * * *